US005456470A

United States Patent [19]

Scheurer

[11] Patent Number: 5,456,470

[45] Date of Patent: Oct. 10, 1995

[54] GOLF SWING TRAINING APPARATUS FOR LIMITING HIP MOVEMENT

[76] Inventor: Robert S. Scheurer, 1627 Midwestern Pkwy., Wichita Falls, Tex. 75302

[21] Appl. No.: 208,576

[22] Filed: Mar. 15, 1994

[51] Int. Cl.[6] ..... A63B 69/36

[52] U.S. Cl. ..... 273/188 R; 482/91

[58] Field of Search ..... 273/187.2, 188, 273/35, 190; 482/62, 91; 434/252

[56] References Cited

U.S. PATENT DOCUMENTS

| | | | |
|---|---|---|---|
| 2,469,301 | 5/1949 | Johnston | 273/35 |
| 2,891,796 | 6/1959 | Cottrell | 273/189 |
| 3,079,152 | 2/1963 | Cushing | 273/35 |
| 3,215,438 | 11/1965 | Sheldon et al. | 273/188 |
| 3,623,733 | 11/1971 | Cavanaugh | 273/187.2 |
| 3,767,204 | 10/1973 | Bryson | 273/187.2 |
| 5,288,074 | 2/1994 | Scheurer | 273/188 R |

*Primary Examiner*—George J. Marlo
*Attorney, Agent, or Firm*—Dennis T. Griggs

[57] ABSTRACT

A hook-shaped hip receiver increases the efficiency of a golf swing by limiting hip rotation and increasing the differential angle between a golfer's shoulders and hips during a back swing, and yieldably opposes hip sway while allowing an unrestricted, full downswing. The hip receiver is slidably coupled to an upright support member by a slider block and spring which yieldably opposes shifting movement of the hip receiver while permitting rotation relative to the upright support member. This permits the golfer's body to remain centered with respect to his feet as the hip receiver pivots about an off-center axis. The hip receiver shifts laterally to remain centered about the golfer's hips, while the spring opposes excessive hip sway movement.

6 Claims, 11 Drawing Sheets

GOLF SWING TRAINING APPARATUS FOR LIMITING HIP MOVEMENT

FIELD OF THE INVENTION

This invention relates generally to golf equipment, and in particular to golf swing practice apparatus.

BACKGROUND OF THE INVENTION

Golfers are constantly seeking to improve their swing techniques to improve control and maximize distance. One common mistake is excessive hip movement, both in rotation and lateral sway, while attempting to hit the ball. It is not a matter of the total turn of the golfer's swing, but rather, the coiled energy or torsional force provided by the torso twist and the efficient transmission of that energy to the ball. By limiting hip-turn with respect to the turn of his upper body, and by maintaining his hips approximately centered with respect to his feet, the golfer can maximize the amount of energy transferred to the golf ball.

DESCRIPTION OF THE PRIOR ART

Golf pros and amateurs alike have practiced avoiding excessive hip movement during the golf swing while a coach provides feedback as to the execution of the swing. This technique requires self-discipline and coaching from another person.

Accordingly, training apparatus is needed which will permit the golfer to practice his golf swing while limiting hip rotation and avoiding hip sway so that energy stored in his torso during wind-up will be efficiently transmitted to the golf ball during the down swing and follow-through. It will also be appreciated that such apparatus is needed to help exercise and train the muscles of the upper body during the execution of a correct swing.

SUMMARY OF THE INVENTION

A hip-turn restrictor is provided for aiding a golfer in the development of a wide differential angle between the hip-turn and the upper body turn. An adjustable hook-shaped hip receiver is coupled to an upright support member for optimal positioning around the hip area. The hook receiver turns freely on a bearing surface in the follow-through direction for allowing an unrestricted downswing. An adjustable stop limits rotation of the hip receiver on the back swing from about 0° to about 45° beyond an initial square stance position. A stop means is provided to stop the turning of the hip receiver in the back swing motion at a chosen point and is adaptable for left and right handed golfers. The actual amount of hip-turn allowed may be increased or decreased by changing the indexed position of a ball joint to activate its built-in horizontal turn limit in the direction of the back swing, by backing off or advancing an index plate.

The hip receiver is slidably coupled to the upright support member by a slider block or bearing assembly which permits rotation and lateral shifting of the hip receiver relative to the upright support member. This allows the golfer's body to remain approximately centered with respect to his feet as the hip receiver pivots about an off-center axis. The hip receiver is shifted laterally to the left as the golfer turns to the right during the back swing, with the result that the hip receiver remains substantially centered about the golfer's hips. A spring yieldably opposes hip sway movement, and re-positions the hip receiver to the starting point after each swing.

TECHNICAL ADVANTAGES OF THE INVENTION

One advantage of the present invention is that it trains a golfer during the back swing and follow-through to limit hip movement with respect to upper body movement.

Another advantage of the present invention is that it provides apparatus for exercising the muscles in the torso which provide the torsional force to drive the ball, and trains the golfer to recognize the special muscle feeling which accompanies a correctly executed swing.

Yet another advantage of the present invention is that it promotes the development of a large differential angle between the shoulder turn and the hip-turn.

Still another advantage of the present invention is that it yieldably opposes hip sway during the wind-up back swing while allowing an unrestricted, full down swing.

BRIEF DESCRIPTION OF THE DRAWINGS

Referring now to the drawings in which like reference numerals and letters indicate corresponding elements throughout the several views.

DETAILED DESCRIPTION OF THE PREFERRED EMBODIMENT

Figure 1:
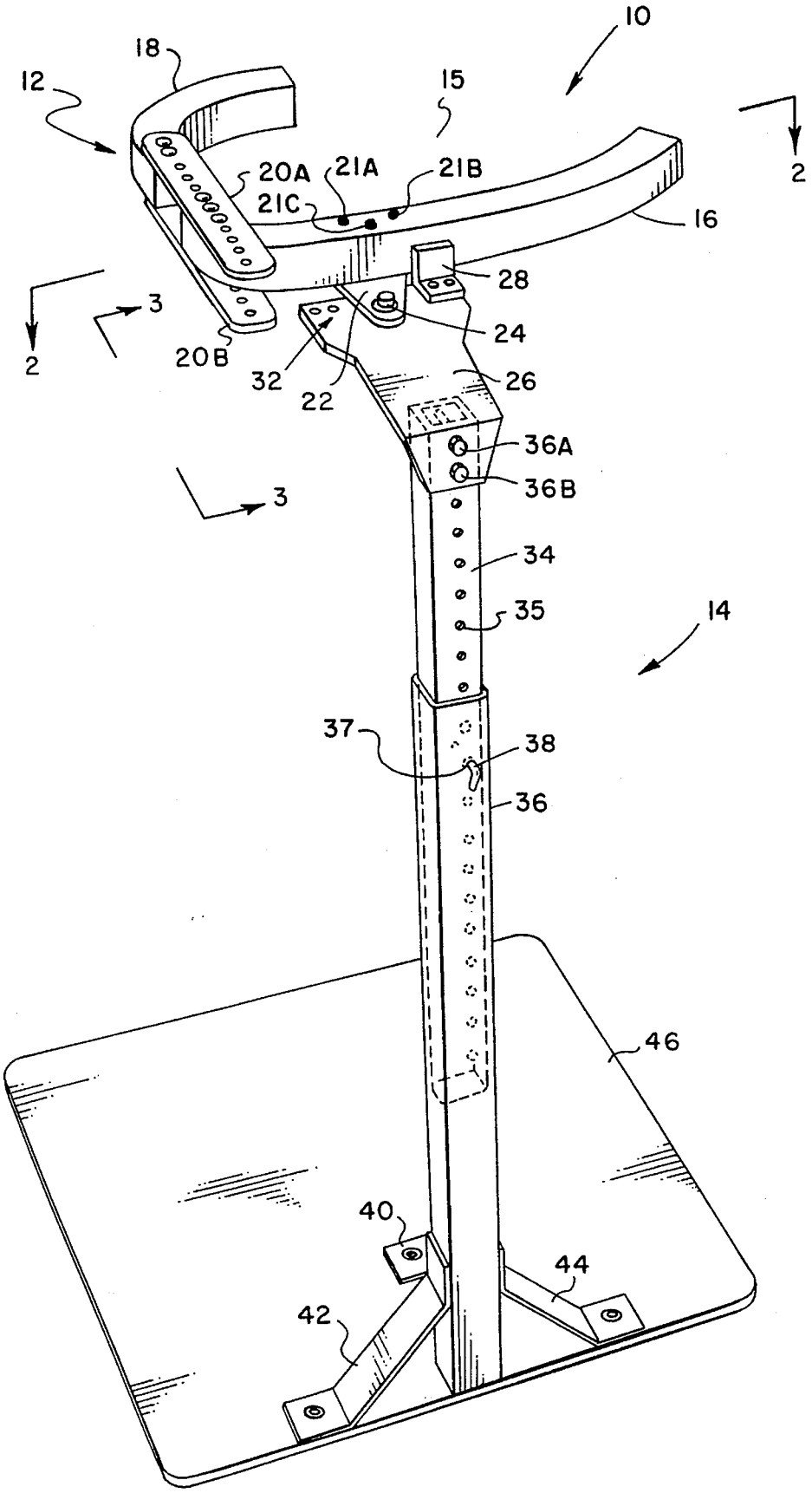
FIG. 1 is a rear perspective view of a golf swing training apparatus constructed in accordance with the principles of the present invention.

Reference is made to FIG. 1 which shows a golf swing training apparatus 10 having a hook-shaped hip receiver 12 movably mounted on an upright support member 14. The hip receiver 12 includes a back receiver section 16, a side receiver section 18, and first and a second adjustment plates 20A and 20B, each plate having a plurality of alignment holes therethrough. The back and side receiver sections are preferably inwardly curved with respect to each other to provide a close conforming fit about the golfer's hips. The back receiver section 16 includes a relatively long, straight coupling section 16A joined with an inwardly curved hook section 16B, thereby defining a long hook section. Similarly, the side receiver section 18 has a relatively short, straight coupling section 18A which is joined to an inwardly curved hook section 18B. The plates 20A and 20B are rigidly attached to the back and side receiver sections 16, 18 with at least one nut and bolt pair. The bolt is received through one of the alignment holes in plate 20A, through an alignment hole in the back receiver section 16, and through a second alignment hole in plate 20B.

The hip receiver 12 is attached via long hook section 16 to a swivel plate 22. The swivel plate 22 is pivotally attached about a fixed shaft 24. The shaft 24 is rigidly mounted in a substantially normal direction to an offset plate 26. A backstop plate 28 is securely but removably attached to the offset plate 26 with threaded screw fasteners, so that the backstop plate 28 may be mounted either to the left or the right of the bearing plate 22 as it pivots around shaft 24. A pair of holes 32 are provided in the angle plate 26 so that the backstop plate 28 may be mounted to the left of the swivel plate 22 for left-handed golfers.

The offset plate 26 is rigidly mounted to a vertically adjustable support tube 34. The support tube 34 is telescopically received within a tubular support sleeve 36. The offset plate 26 is attached at a substantially right angle to the support tube 34 with first and second screw fasteners 36A, 37A and 36B, 37B, respectively. It should be understood that the offset plate 26 may be secured to the support tube 34 by other means such as by welding, as desired.

In the preferred embodiment, the support tube 34 is a square cross-section and has multiple index holes 35 equally spaced along its length. The tubular sleeve 36 is also square and of slightly larger dimensions than the tube 34, and has at least one index hole 37 for alignment with at least one of the index holes 35 in the tube 34. A securing pin 38 is fitted through the aligned index holes for securing the tube 34 to the fixed sleeve 36 at a preferred upright service height. The pin 38 is easily removable so that the support tube 34 may travel up and down within the support sleeve 36 for aligning the hip receiver 12 for comfortable engagement with the preferred hip region of the golfer.

Preferably, the hip receiver sections 16, 18, the tube 34, and the sleeve 36 are fabricated from lightweight aviation grade aluminum tubing which may be formed and machined into the preferred shape with conventional tools. The preferred wall thickness for the tubing is one-eighth of an inch. The preferred outer dimensions for the sleeve 36 are approximately two inches square; for the tube 34, approximately one and three-quarter inches square; and for the tubular hook receiver sections 16, 18 of the hip receiver 12, approximately between one and one-half to one and three-quarters of an inch square. It should be understood that the tubing may also have a round, oval or rectangular shape and may be made of wood, steel, glass-filled nylon, or other rigid material, without departing from the scope of the present invention.

The lower end of the sleeve 36 is attached to support brackets 40, 42 and 44 respectively, arranged in a tripod configuration and attached to a base 46. The base 46 spans an area substantially perpendicular to the tube 34 and the sleeve 36 and is best suited for indoor use wherein the golfer stands on the base 46 to secure the entire assembly. The base 46 may be made of plywood or plastic material.

Referring now to the hip receiver 12 in more detail, the short receiver section 18 is adjustable with respect to the long receiver section 16 so that the hip receiving opening 15 provides a comfortable fit about the hip/waist area of the golfer. The long receiver section 16 is curved so that it follows a parallel path with the swing of the golfer.

The hip receiver 12 freely pivots on the shaft 24 in the follow-through direction (shown in FIG. 1 as counterclockwise viewed from the top) to allow the golfer an unrestricted down swing. In the wind-up direction (clockwise in FIG. 1), the backstop plate 28 limits the hip-turn on the back swing from proceeding past the initial square stance position of the golfer.

Figure 10:
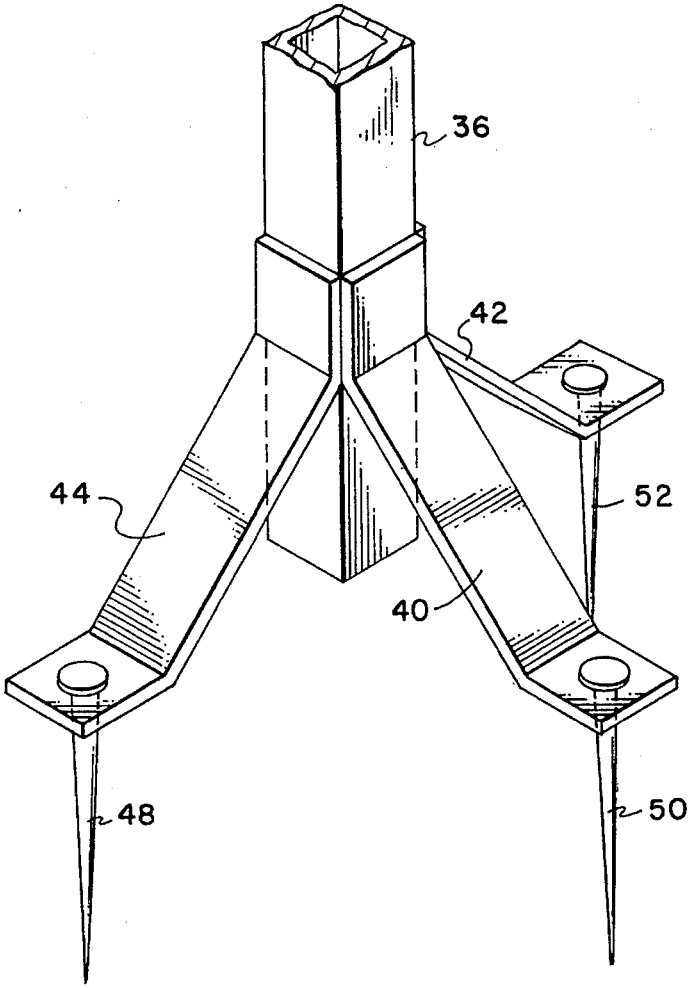
FIG. 10 is a partial perspective view showing a typical support arrangement.

An alternative base support arrangement, suitable for outdoor use, is shown in FIG. 10. The first, second and third brackets 40, 42 and 44 are arranged in a tripod configuration and are attached to the lower end of the sleeve 36. Spikes 48, 50 and 52 project through holes in the brackets 40, 42, and 44 respectively, for securing the assembly into the soil.

Figure 2:
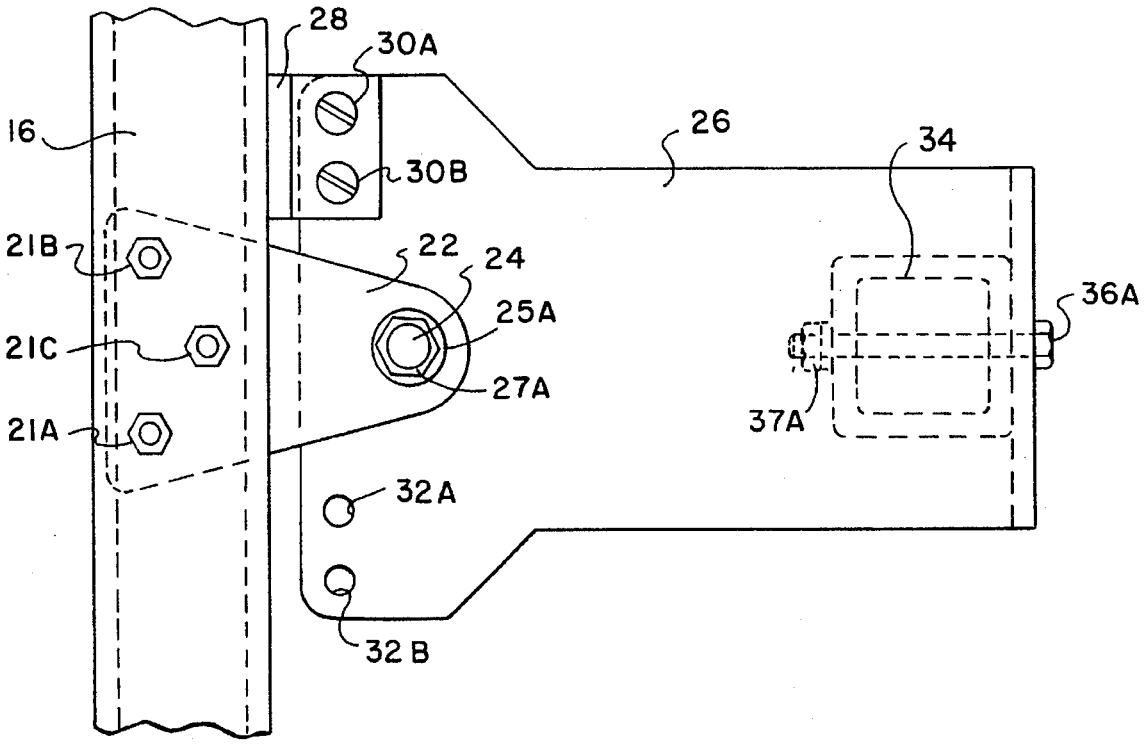
FIG. 2 is a partial top plan view of the golf swing training apparatus taken along the line 2—2 of FIG. 1.
Figure 3:
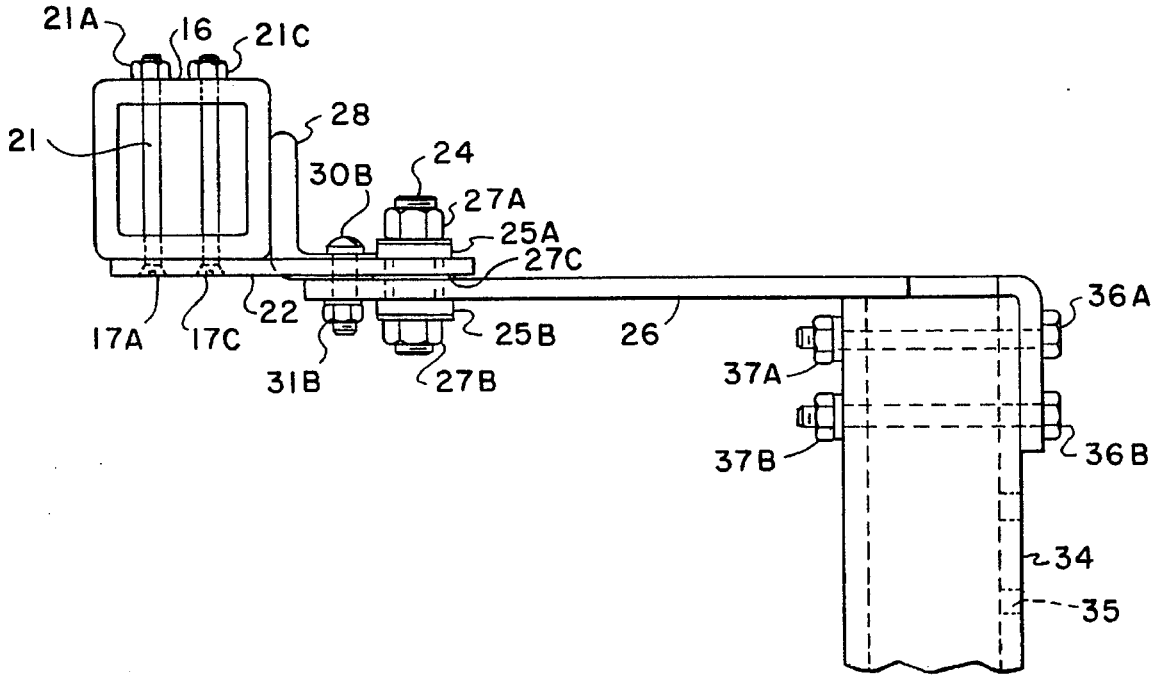
FIG. 3 is a side elevation view of the golf swing training apparatus taken along the line 3—3 of FIG. 1.

Reference is now made to FIG. 2 and FIG. 3 in which the long hip receiver section 16 is coupled to the bearing plate 22 and pivotable about the fixed shaft 24. The bearing plate 22 is pivotally disposed around the shaft 24 and secured thereto with a shoulder washer 25A and a securing nut 27A. The upright support tube 34 is shown in hidden lines as being attached to the underside of the angle plate 26 with a nut 37A and a bolt 36A. The backstop plate 28A is shown attached to the upper surface of the angle plate 26 by threaded bolt fasteners 30A, 30B, respectively. It should be understood that the backstop plate 28 may be mounted through left-handed holes 32A and 32B with bolts 30A and 30B for accommodating a left handed golfer.

Reference is now made to FIG. 3 which shows attachment of the long hook section 16 to the bearing plate 22 with the bolts 17A and 17B and the nuts 21A and 21B respectively. It should be understood that the long hook section 16 may be attached with other means such as by welding to the bearing plate 22, as desired. The long hook section 16 is engagable with the backstop plate 28 for limiting its pivotable motion in the clockwise direction as viewed from the top.

The backstop plate 28A is secured to the angle plate 26 with bolts 30A, 30B and nuts 31A, 31B. The shaft 24 has threads on selected portions on both of its ends for receiving the nuts 27A and 27B and for attaching the bearing plate 22 therebetween while allowing it to rotate thereabout. A first shoulder washer 25A and a second shoulder washer 25B are disposed outwardly concentric about the shaft 24 and inwardly concentric about a through hole in the bearing plate 22. The washers 25A and 25B provide a bearing surface for the plate 22 as it rotates about the shaft 24.

The upright support tube 34 is coupled to the angle plate 26 with bolts 36A, 36B and nuts 37A, 37B respectively. It should be understood that the support tube 34 may be fixed to the angle plate 26 by other means, for example by a spot weld joint.

Figure 4:
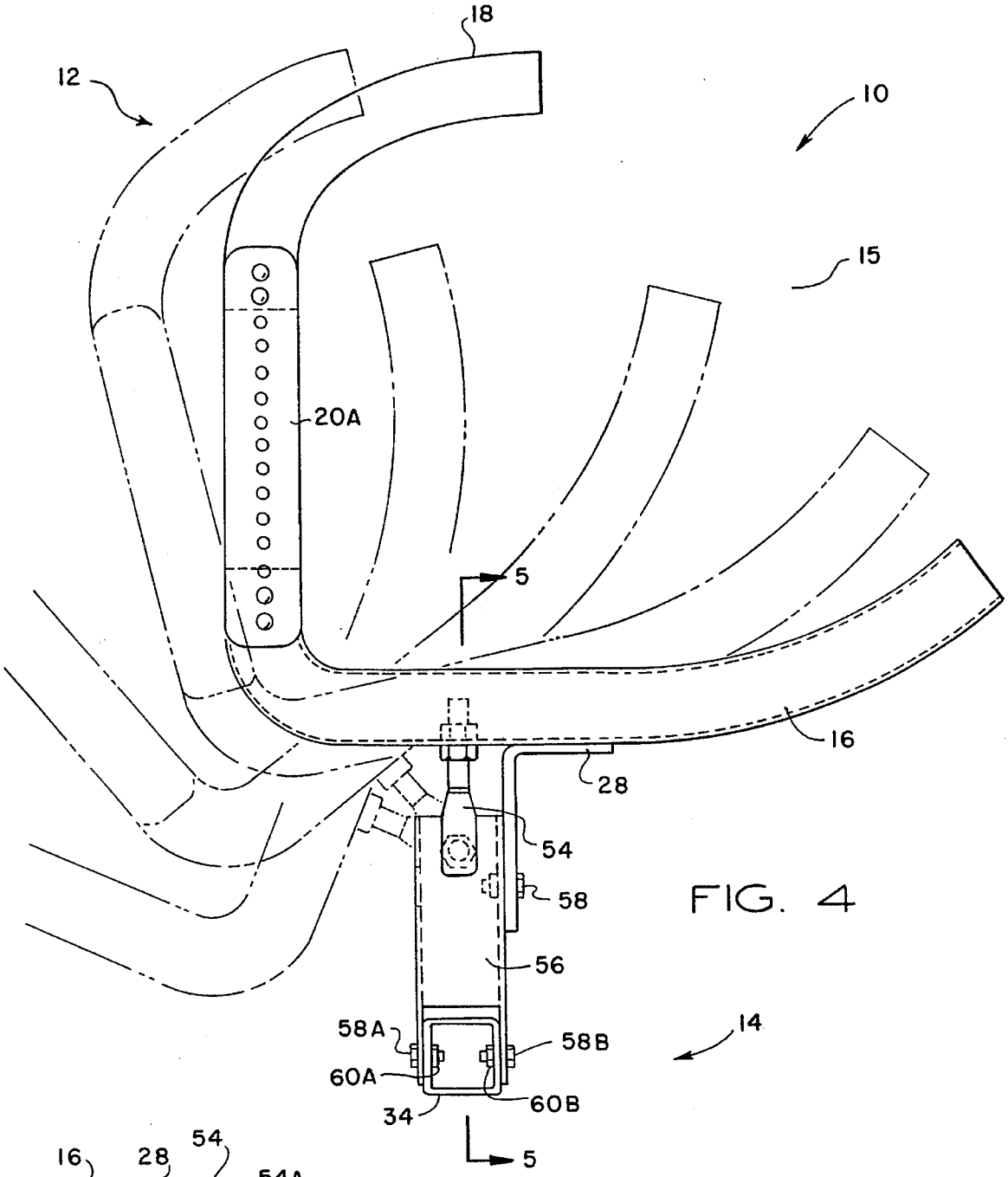
FIG. 4 is a top plan view thereof showing phantom views in a variety of positions, thus illustrating the unique manner in which the hook-shaped, hip receiver moves in response to turning movement of the hips during a back swing.
Figure 5:
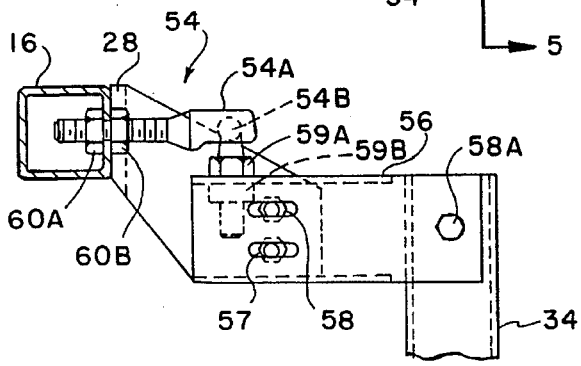
FIG. 5 is a cutaway side elevation view of the golf swing training apparatus taken along the line 5—5 of FIG. 4.

Reference is now made to FIGS. 4 and 5 in which backstop plate 28 is side mounted with a nut 51A and a bolt 53A to an offset bracket 56 for limiting clockwise motion of the hip-turn receiver 12 about the shaft 24. Holes 57 and 59 are provided in the offset bracket 56 so that a mirror image bracket (not shown) may be installed on the left side of the shaft 24 and the hip receiver 12 rotated 180° for use by left-handed golfers. The hip receiver 12 is shown in various phantom positions.

The short hook section 18 is positioned adjacent the leading hip for a right handed golfer. The long hook section 16 is engaged adjacent the trailing hip or the back hip of the right handed golfer. The perforated adjustment plate 20A is adjusted so that the opening 15 between the receiver sections 16 and 18 provides easy entry and exit for the golfer's hips.

A universal ball and socket assembly 54 couples the long member 16 to an offset bracket 56. The offset bracket 56 is attached to the tube 34 at a substantial right angle with a first and a second bolt 58A, 58B and a first and a second nut 60A and 60B.

Referring to FIG. 5, the universal ball joint assembly 54 includes a socket member 54A in operative engagement with a ball member 54B. The socket member 54A extends substantially at a right angle to the ball member 54B and gimbals thereabout. The distal end of the socket member 54A is threaded for coupling to the long hook section 16 with jam nuts 60A and 60B. The offset bracket 56 is preferably attached to the upright support tube 34 by means of nut and bolt pairs 58A, 60A and 58B, 60B. The ball member 54B has a threaded shaft for attachment to the offset bracket 56.

Figure 6:
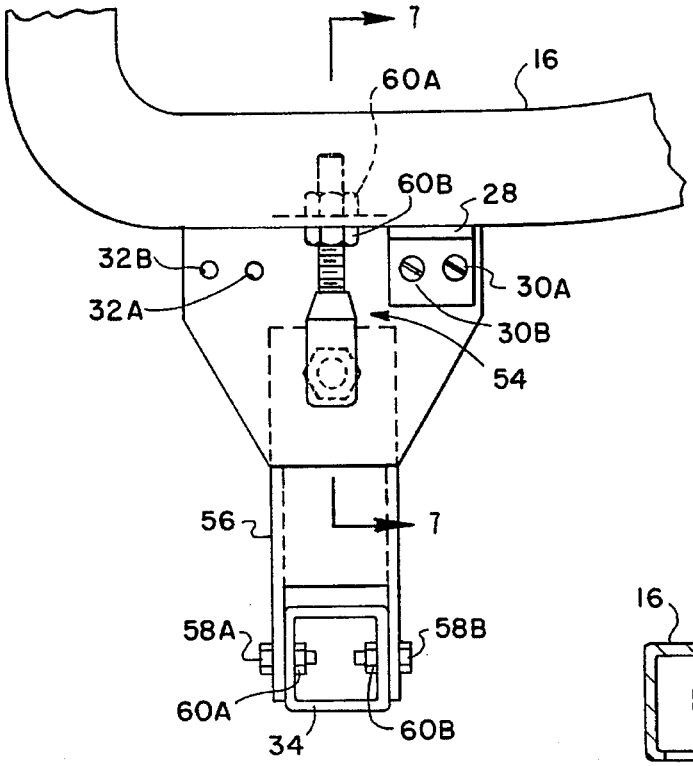
FIG. 6 is a partial top plan view of the golf swing apparatus having an alternative stop plate configuration.
Figure 7:
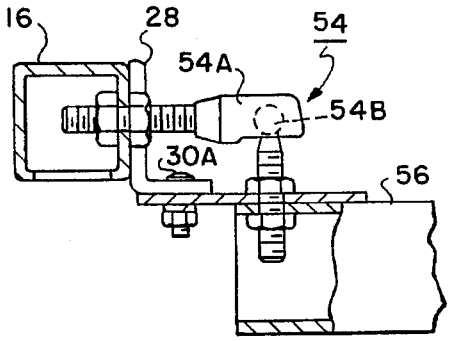
FIG. 7 is a partial side sectional view of the alternative embodiment taken along the line 7—7 of FIG. 6.

Referring now to FIGS. 6 and 7, the universal ball and socket assembly 54 is attached to the long hook section 16 with an inner jam nut 60A and an outer jam nut 60B threaded on the threaded distal end of the socket member 54A. The angle member 56 is attached to the tube 34 with a first nut and bolt pair 58A and a second nut and bolt pair 58B. As shown in FIG. 7, the universal ball and socket assembly 54 movably couples the hip receiver 14 to the vertical telescoping support tube 34, so that the hip receiver 14 may gimbal about a fixed vertical reference.

Figure 8:
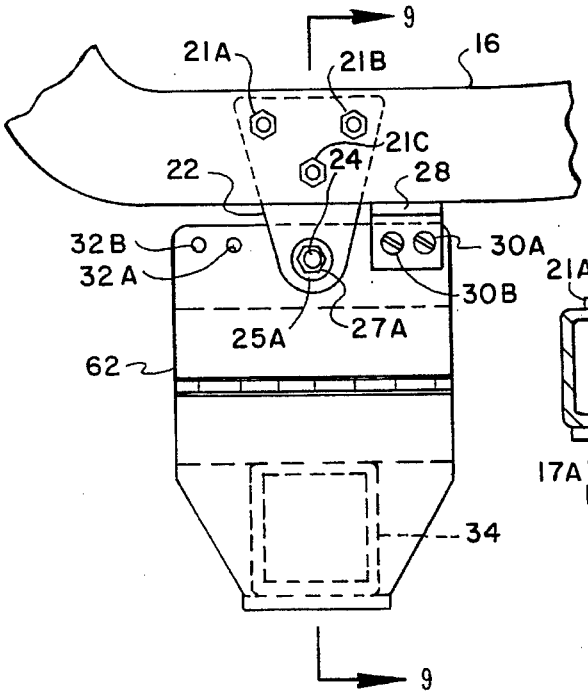
FIG. 8 is a partial top plan view of a golf swing training apparatus having an alternative hinge arrangement.
Figure 9:
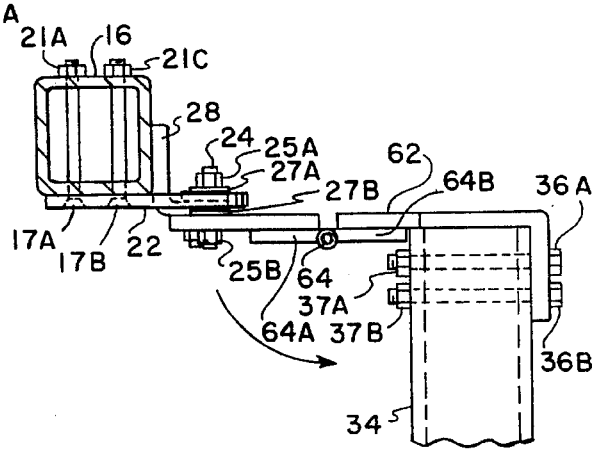
FIG. 9 is a partial side sectional view of the alternative embodiment taken along the line 9—9 of FIG. 8.

Referring to FIG. 8 and FIG. 9, the bearing plate 22 is pivotally attached to the shaft 24 by a hinge plate 62. The shaft 24 has threads on both proximal and distal ends and the bearing plate 22 is fixed on the shaft with the shoulder bushing 25A and the securing nut 27A. The hinge plate 62 permits pivotal movement in the vertical direction and substantially perpendicular to the rotational axis around the shaft 24.

The bearing plate 22 is coupled to the fixed shaft 24 and rotatable thereabout with the shoulder bushings 27A and 27B with the nuts 25A and 25B. The hinge plate 62 hinges along the axis 64 so that the hip receiver 12 pivots toward and away from the support tube 34. The hinge plate 64 is attached to the support tube 34 with the bolts 36A and 36B and the nuts 37A and 37B respectively.

Figure 11:
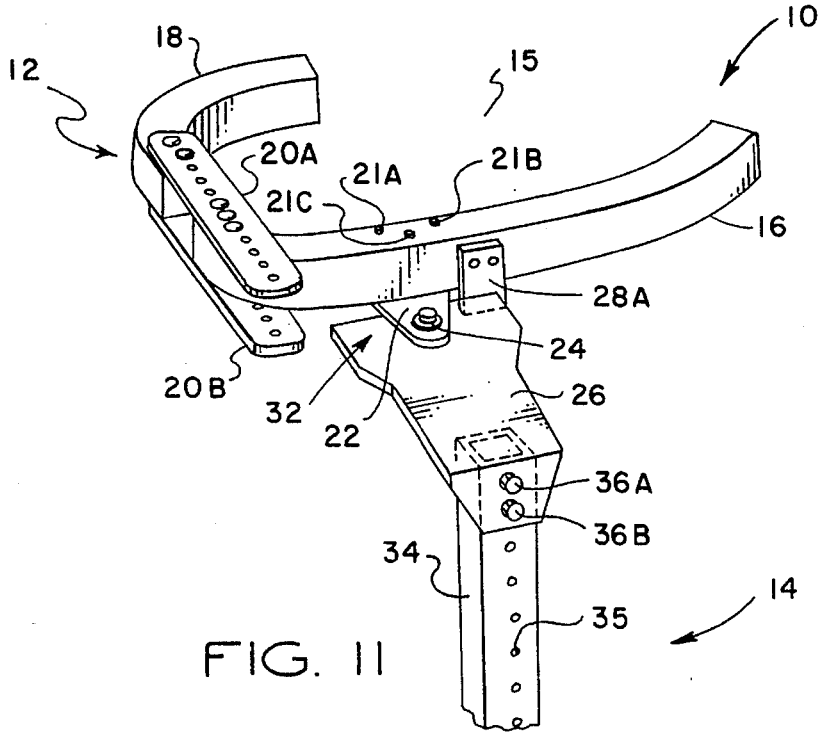
FIG. 11 is a perspective view showing an alternative mounting arrangement for the backstop plate.
Figure 12:
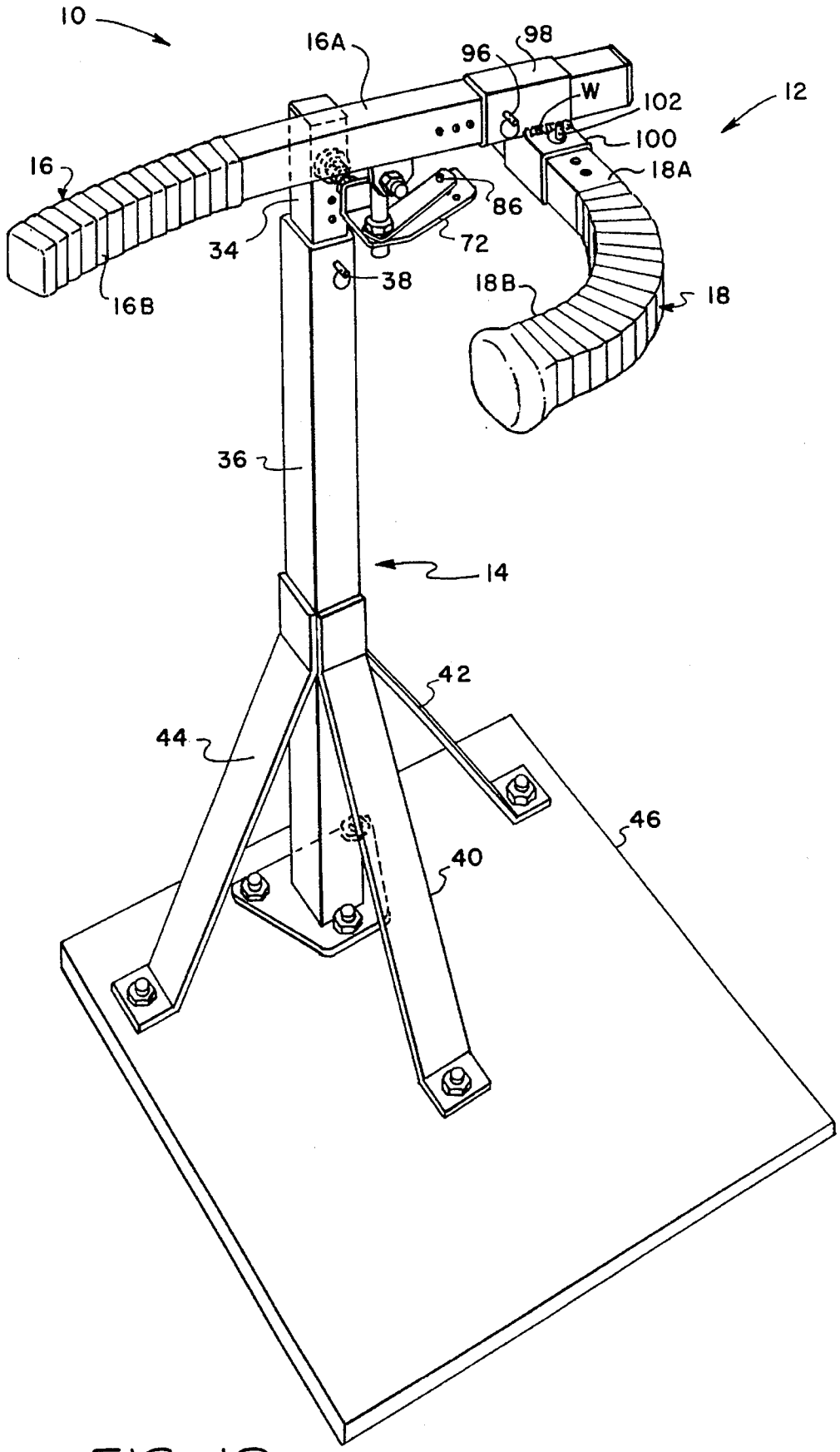
FIG. 12 is a front perspective view of a golf swing training apparatus constructed according with an alternative embodiment of the present invention.
Figure 13:
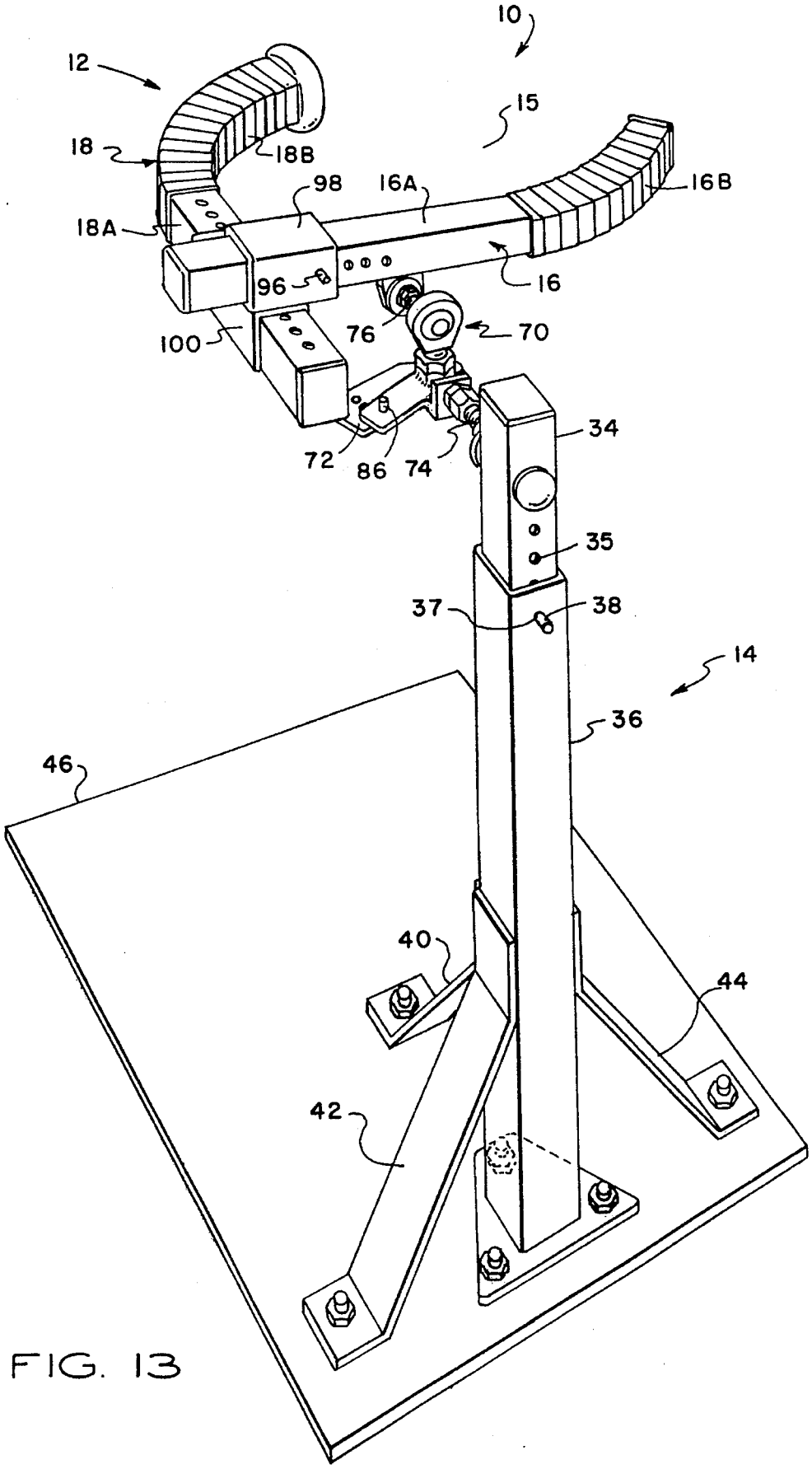
FIG. 13 is a rear perspective view of the golf swing training apparatus shown in FIG. 12.

In an alternative backstop arrangement as shown in FIG. 11, a backstop plate 28A is attached to and carried by the long hook section 16. The backstop plate 28A has a depending portion which is engageable against the offset bracket 26 at the limit of clockwise turning movement of the hip receiver 12 relative to the support shaft 34.

Figure 14:
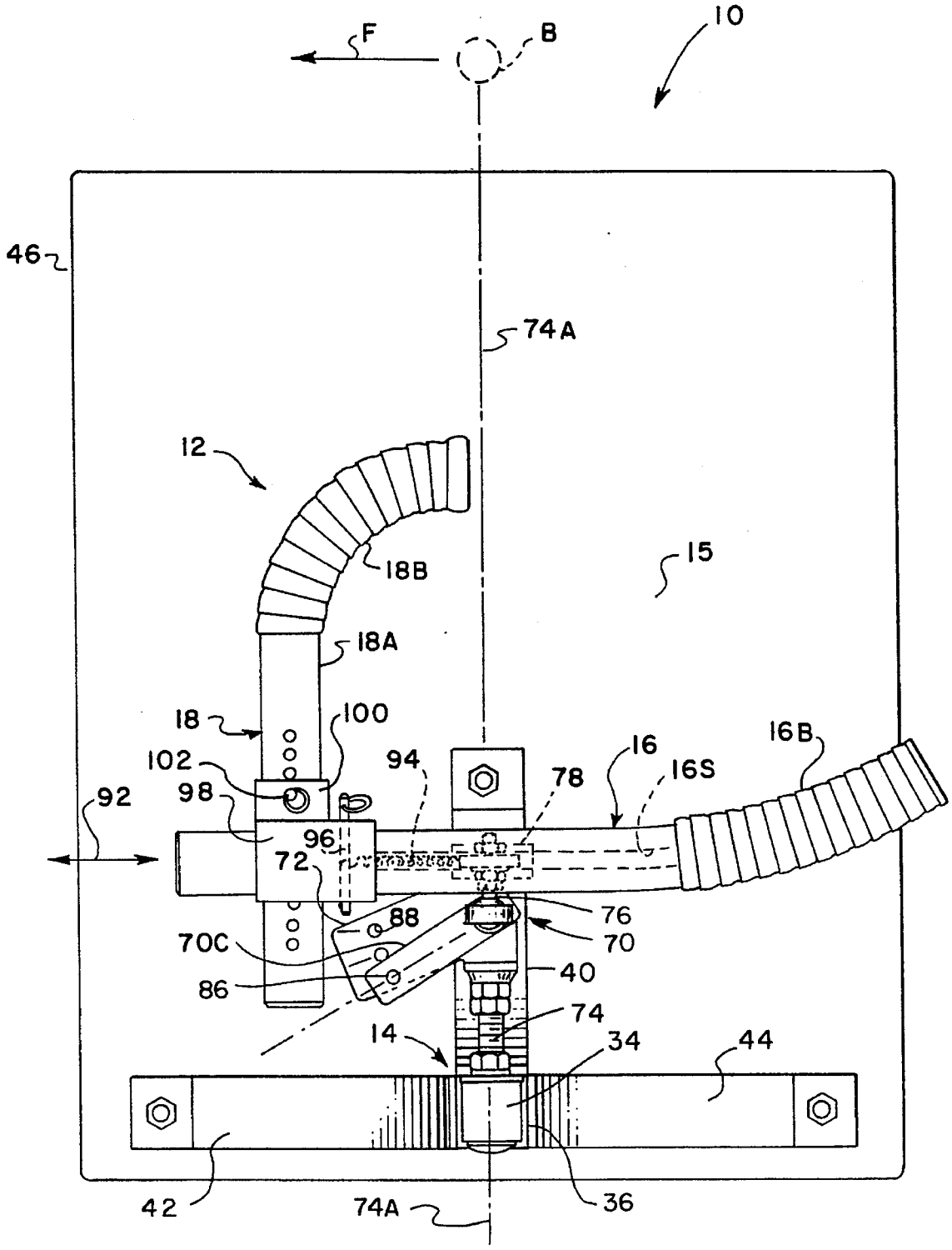
FIG. 14 is a top plan view thereof.

Referring now to FIG. 12 through FIG. 20, the hip receiver 12 is coupled to the upright support member 14 by a universal ball joint assembly 70 which includes a socket member 70A in operative engagement with a ball member 70B. In this embodiment, the socket member 70A is supported in a fixed position by an index plate 72 which is rigidly attached to the upright support tube 34 by a threaded anchor bolt 74. The longitudinal axis 74A of the anchor bolt is in alignment with a golf ball B which is placed adjacent the forward end of the base 46. The longitudinal axis 74A extends at substantially a right angle with respect to the intended line of flight of the golf ball, represented by the arrow F (FIG. 14).

The hip receiver 12 is movably coupled to the universal ball joint assembly 70 by a coupling arm 76. According to one aspect of the invention, the coupling arm 76 is movably coupled to the long hook section 16 of the hip receiver 12 by a bearing block 78. The bearing block 78 is slidably received within the hollow space 80 within the straight tubular hook section 16A. The bearing block 78 is dimensioned appropriately for smooth, slidable movement through the space 80, which defines a slip channel for guiding reciprocal shifting movement of the hip receiver 12 relative to the bearing block 78.

The tubular hook section 16 has a lower side panel 16P which is intersected by a longitudinal slot 16S. The bearing block 78 is connected to the coupling arm 76 by a coupling plate 82. The coupling plate 82 is rigidly attached to the bearing block 78 and projects downwardly through the longitudinal slot 16S.

Figure 15:
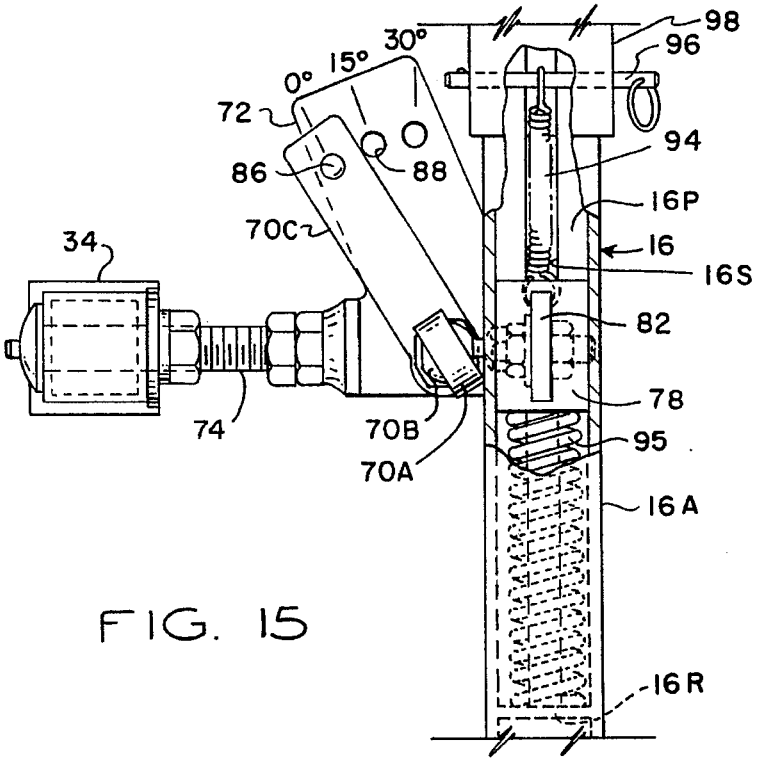
FIG. 15 is a top plan view, partially broken away and partially in section showing the hip turn limit adjustment and hip sway compensation apparatus of the present invention.

According to this arrangement, the bearing block 78 is pivotally attached to the upright support member 34 by the universal ball and socket coupling assembly 70. Angular movement of the hip receiver 12 is limited by engagement of the coupling arm 76 against the socket housing 70A. The angular position of the socket housing 70A relative to the longitudinal axis 74A may be adjusted so that the coupling arm 76 at its point of engagement against the socket housing 70A is exactly in alignment with the square stance longitudinal axis 74A. This corresponds with a setting of the index plate at the zero degree position (FIG. 15). Adjustment is carried out by releasing a wing nut fastener 84 and rotating the socket housing 70A until its index arm 70C is in alignment with the desired scribe mark. The angular offset angle alpha ($\alpha$) is fixed by an index pin 86 which is inserted through the index arm and an index hole 88 formed through the coupling plate 72.

Figure 20:
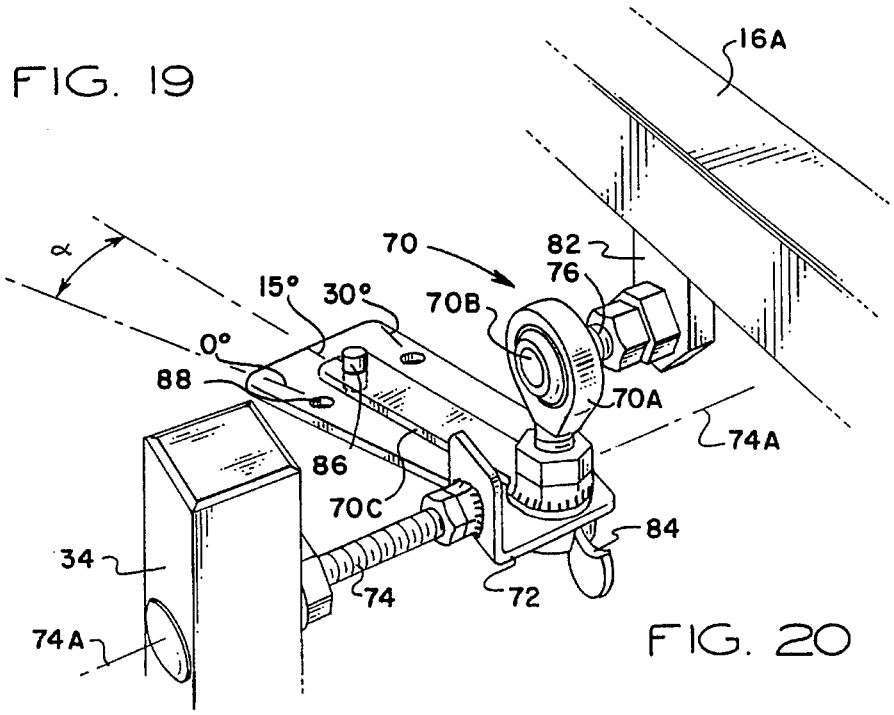
FIG. 20 is a perspective view, partially broken away, showing the hip turn limit adjustment apparatus.

As shown in FIG. 20, the index arm 70C is aligned for angular offset of $\alpha$=15°. This means that the hip receiver is permitted to turn through an angle of 15° relative to the square stance longitudinal axis 74A until the coupling arm 76 engages the socket housing 70A during a back swing wind-up.

Because the hip receiver 12 is pivotable about an off-center axis 90, the short hook section 18 of the hip receiver may push against the golfer's body, causing excessive hip sway, forcing the golfer's body out of the centered position with respect to his feet and the square stance position.

Excessive hip sway movement is avoided by the bearing block coupling arrangement described above. In response to a back swing hip turn, the hip receiver 12 rotates clockwise through the offset angle $\alpha$ as previously set by adjustment of the index arm 70C. As the hip receiver turns through the offset angle, the short hook section 18 applies a lateral shifting force against the golfer's body, which may cause excessive hip movement in the absence of compensation. Such excessive hip sway movement will interfere with the golf swing, resulting in a reduction of energy transferred to the ball and a misdirection of the ball.

That situation is avoided in the present invention by the bearing block coupling arrangement which permits the hip receiver 12 to move laterally relative to the bearing block 78 in response to off-center pivotal turning movement of the hip receiver relative to the pivot axis 90. That is, as hip rotation occurs, the hip receiver 12 is shifted laterally with respect to the bearing block 78 as indicated by the arrow 92 (FIG. 14). The bearing block 78 is secured to the ball and socket coupling assembly 70, and thus does not undergo lateral shifting movement. Instead, the tubular hook section 16 slides to the left relative to the bearing block 78 until the limit of the angular offset is reached. This permits the golfer's body to remain substantially centered with respect to his feet and with respect to the square stance axis 74A as the hip receiver pivots about the off-center axis 90.

Figure 16:
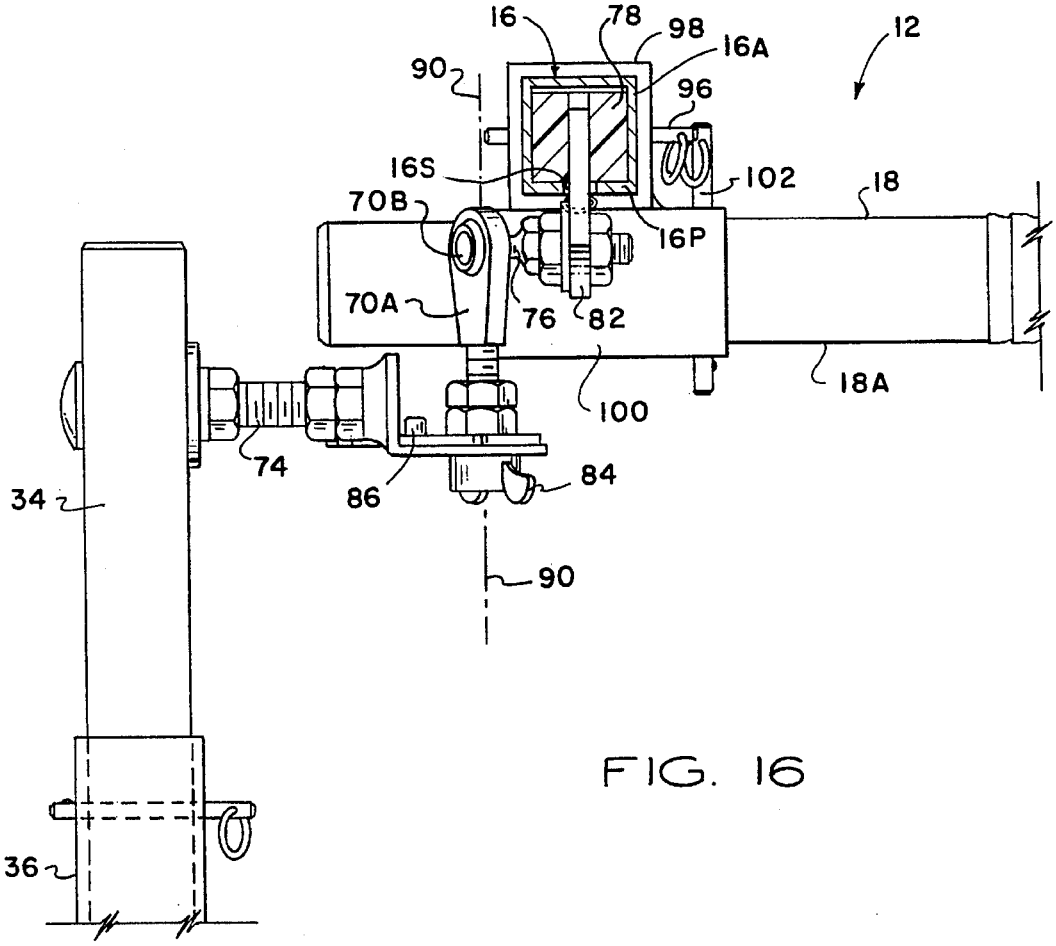
FIG. 16 is a side elevational view thereof, partly in section and partly broken away.
Figure 17:
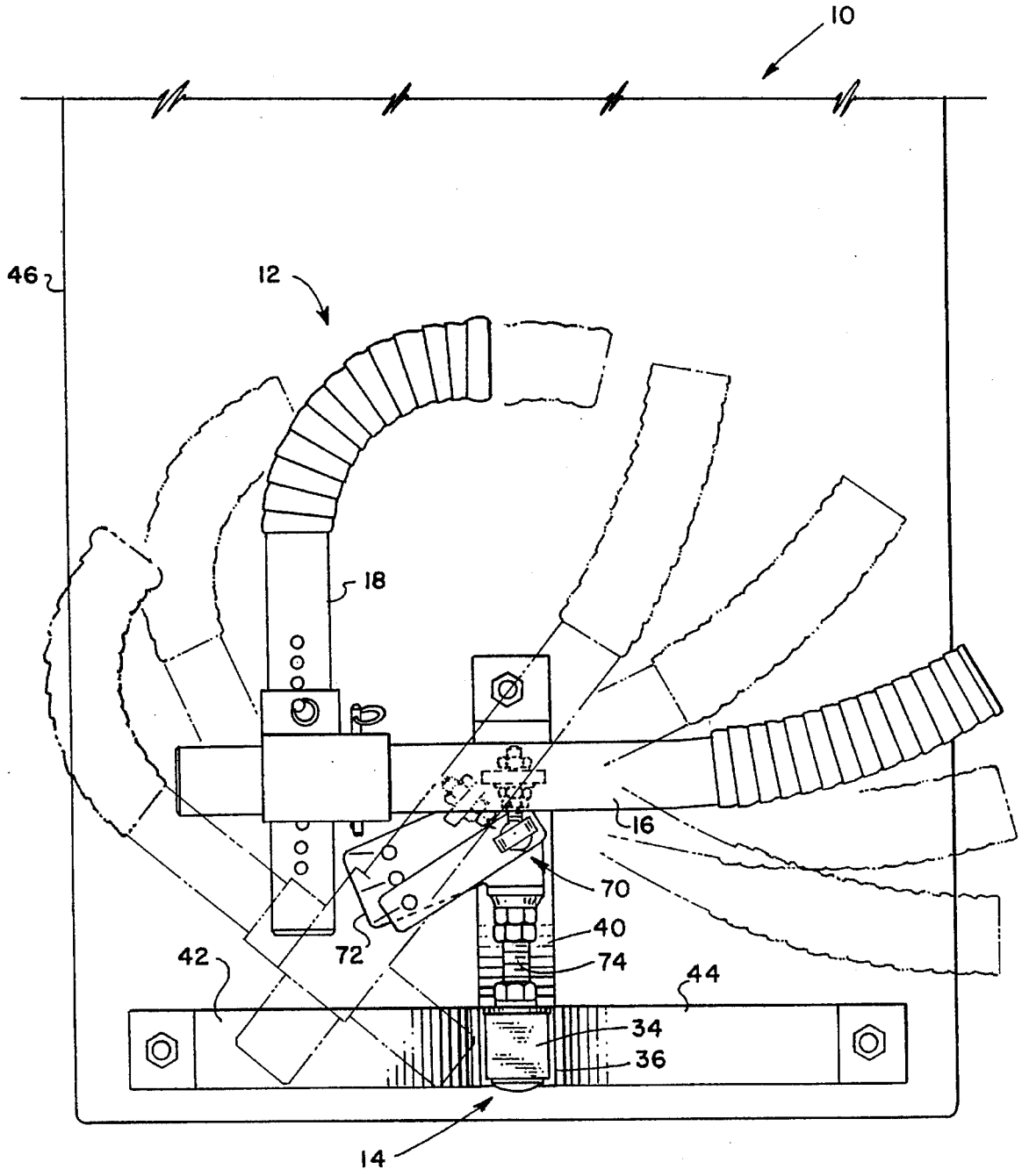
FIG. 17 is a top plan view showing phantom views in a variety of positions, which illustrates the unique manner in which the hook-shaped hip receiver moves in response to turning movement of the hips during a back swing.

According to another aspect of the invention, the shifting movement of the hip receiver 12 relative to the bearing block 78 is yieldably opposed by a coil spring 94. The coil spring 94 is connected between the tubular hook section 16 and the bearing block 82. According to one connecting arrangement, as shown in FIG. 15, the coil spring 94 is enclosed within the tubular channel space 80, and is anchored on its opposite ends to the bearing block 78 and to a retainer pin 96, so that it undergoes yieldable tension loading in response to clockwise rotation of the hip receiver 12. As shown in FIG. 15 and FIG. 16, the retainer pin 96 projects through the channel space and is secured to the tubular hip receiver section 16.

Figure 18:
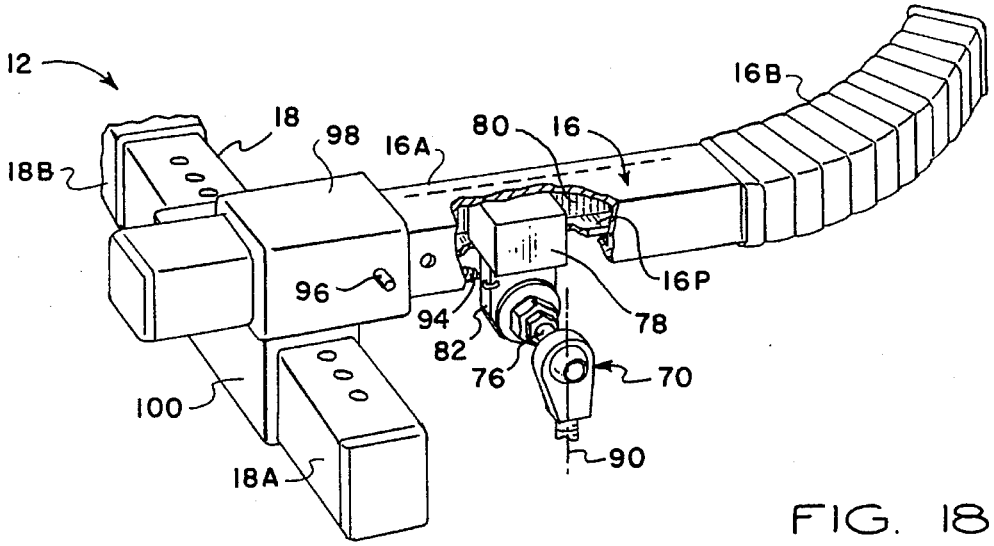
FIG. 18 is a perspective view thereof, partially broken away, illustrating the hip sway compensation apparatus.
Figure 19:
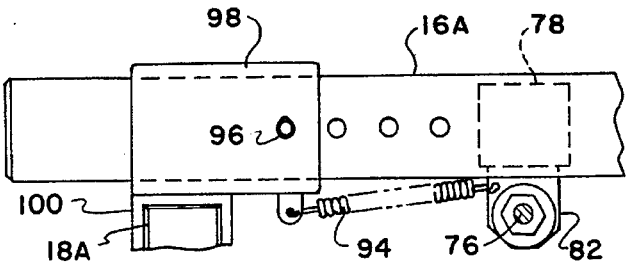
FIG. 19 is a front elevational view thereof, partially broken away.

Alternatively, as shown in FIG. 18 and FIG. 19, the coil spring 94 is secured on its opposite ends to the coupling plate 82 and a support bracket 98, and is mounted externally with respect to the hip receiver 12.

A coil spring 95 may also be interposed between the bearing block 78 and a retainer member 16R of the long hook section 16 so that the coil spring 95 undergoes yieldable compression loading in response to clockwise rotation of the hip receiver 12, as shown in FIG. 15.

The long and short receiver sections 16, 18 are adjustably coupled together by the tubular support brackets 98, 100. The tubular support brackets 98, 100 are oriented substantially at a right angle with respect to each other, and are rigidly secured together by a weld W. The straight, tubular sections 16A, 18A are slidably received within the tubular support brackets 98, 100, respectively. The opening 15 between the curved hook sections 16B, 18B is enlarged and contracted by extending and retracting the straight end sections with respect to the mounting brackets. The adjusted position of each hook member is set by the retainer pins 96, 102, which are inserted through aligned index holes formed in the mounting brackets and in the straight receiver sections, respectively.

As the hip receiver 12 is shifted laterally to the left, the coil spring 94 yieldably opposes shifting movement of the hip receiver while permitting rotational movement of the hip receiver relative to the upright support member 14. By this arrangement, the hip receiver 12 shifts laterally to remain centered about the golfer's hips, while the spring 94 also yieldably opposes hip sway movement. The reaction force applied against the golfer's hips provides a feedback signal which indicates correct hip movement during the wind-up back swing.

The foregoing description of the preferred embodiments of the invention have been presented for the purposes of illustration and description. It is not intended to be exhaustive or to limit the invention to the precise form disclosed. Various modifications and variations are possible in light of the above disclosure. It is intended that the scope of the invention be limited not by this detailed description, but rather by the claims appended hereto.

I claim:

1. Golf swing training apparatus comprising:

a support member adapted for upright service;

a hip receiver coupled to the support member for rotation relative thereto;

stop means coupled to one of the support member and the hip receiver for limiting rotation of the hip receiver relative to the support member; and, bearing means slidably coupled between the hip receiver and the support member for permitting lateral shifting movement of the hip receiver relative to the support member.

2. Golf swing training apparatus as defined in claim 1, wherein the hip receiver includes portions defining a guide channel, the bearing means comprising:

a bearing block coupled to the support member; and the bearing block being received within and movable along the guide channel.

3. Golf swing training apparatus as defined in claim 1, including a spring coupled between the hip receiver and the bearing means for resiliently opposing lateral shifting movement of the hip receiver relative to the support member.

4. Golf swing training apparatus as defined in claim 3, wherein:

the spring is a coil spring connected in tension between the hip receiver and the bearing means.

5. Golf swing training apparatus as defined in claim 3, wherein:

the spring is a coil spring coupled under compression between the hip receiver and the bearing means.

6. Golf swing training apparatus comprising:

a support member adapted for upright service;

a hip receiver coupled to the support member for rotation relative thereto; and, bearing means slidably coupled between the hip receiver and the support member for permitting lateral shifting movement of the hip receiver relative to the support member.

* * * * *